US006604856B2

(12) United States Patent
Baumgartner et al.

(10) Patent No.: US 6,604,856 B2
(45) **Date of Patent: *Aug. 12, 2003**

(54) USE OF FILTER TO IMPROVE THE DIELECTRIC BREAKDOWN STRENGTH OF X-RAY TUBE COATING

(75) Inventors: Charles Edward Baumgartner, Schenectady, NY (US); James Day, Scotia, NY (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/944,773

(22) Filed: Oct. 6, 1997

(65) Prior Publication Data

US 2002/0196905 A1 Dec. 26, 2002

(51) Int. Cl.[7] ..... H01J 35/10

(52) U.S. Cl. ..... 378/200; 378/202

(58) Field of Search ..... 378/200, 202

(56) References Cited

U.S. PATENT DOCUMENTS

| | | | | | |
|---|---|---|---|---|---|
| 3,617,580 | A | * | 11/1971 | Geyer | 210/60 |
| 3,939,079 | A | * | 2/1976 | Uchiyama | 210/504 |
| 5,440,608 | A | | 8/1995 | Peralta et al. | 378/199 |
| 5,596,622 | A | | 1/1997 | Peralta et al. | 378/199 |

* cited by examiner

*Primary Examiner*—Craig E. Church
(74) *Attorney, Agent, or Firm*—Noreen C. Johnson; Philip D. Freedman

(57) ABSTRACT

The useful life of x-ray tubes is extended by filtering metal particles and other decomposition products out of the coolant fluid by filter means permanently included in the closed loop cooling fluid circuit which also includes pump means and heat exchange means.

3 Claims, 1 Drawing Sheet

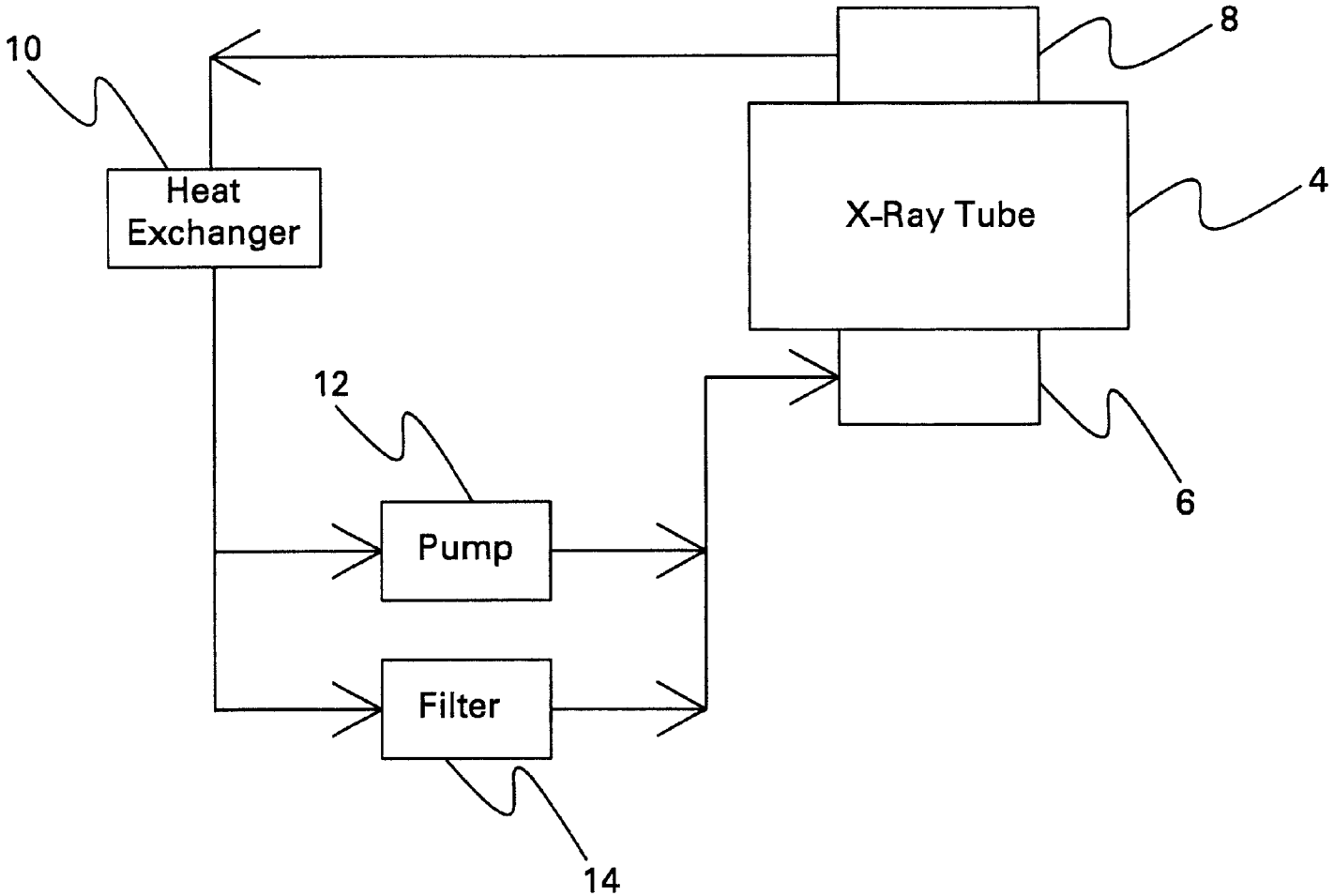
8
4
6
X-Ray Tube
Heat Exchanger
10
Pump
12
Filter
14

USE OF FILTER TO IMPROVE THE DIELECTRIC BREAKDOWN STRENGTH OF X-RAY TUBE COATING

The present invention relates to oil cooled x-ray tubes and to means for extending the service life of x-ray tubes used in x-ray generating equipment for diagnostic and therapeutic radiology such as computerized axial tomography.

X-ray tubes are normally enclosed in an oil-filled protective casing. A glass or metal envelope contains a cathode plate, a rotating disk target and a rotor that is part of a motor assembly that spins the target. A stator is provided outside the tube proximate to the rotor and overlapping therewith. The glass envelope is enclosed in an oil-filled lead casing having a window through which the x-rays that are generated escape the tube. The casing in some x-ray tubes may include an expansion vessel, such as a bellows.

X-rays are produced when, in a vacuum, electrons are released, accelerated and then abruptly stopped. This takes place in the x-ray tube. To release electrons, the filament in the tube is heated to incandescence by passing an electric current through it. The electrons are accelerated by a high voltage, ranging from about ten thousand volts to in excess of hundreds of thousands of volt, between the anode and the cathode and impinge on the anode, whereby they are abruptly slowed down. The anode, usually referred to as the target, is often of the rotating disc type, so that the electron beam is constantly striking a different point on the anode perimeter. The x-ray tube itself is made of glass or metal, but is enclosed in a protective casing that is filled with oil to absorb the heat produced. High voltages for operating the tube are supplied by a transformer. The alternating current is rectified by means of rectifier tubes or barrier-layered rectifiers.

For therapeutic purposes, e.g., the treatment of tumors, the x-rays employed are in some cases generated at much higher voltages (over 4,000,000 volts). Also, the rays emitted by radium and artificial radiotropics, as well as electrons, neutrons and other high speed particles produced by a betatron are used in radio therapy.

The present invention includes an x-ray tube comprising: a glass or metal envelope; a cathode operatively positioned in the glass envelope; an anode assembly including a rotor, a stator, operatively positioned relative to the rotor, and a target or anode operatively positioned relative to the cathode and connected to the rotor.

Another aspect of the present invention is an x-ray system comprising; an enclosure having dielectric cooling oil contained therein; an oil pump positioned relative to the enclosure for circulating the oil within the system; at least one cooling means connected to the enclosure and the oil pump, for cooling the oil; an x-ray tube, positioned inside the enclosure, for generating the x-rays, the x-ray tube comprising: a glass or metal envelope; a cathode positioned in the glass frame; an anode assembly including a rotor, a stator positioned relative to the rotor, and a target positioned relative to the cathode and connected to a stem.

BACKGROUND OF THE INVENTION

Dielectric oils possess a dielectric breakdown strength of 80 kv for a 40 mil gap when the oils are clean and dry. However, the breakdown strength decreases rapidly when the oil becomes contaminated with moisture, particles, or polar chemicals. For example, the dielectric breakdown strength may be reduced by as much as 50% by addition of 35 ppm water, 50 ppm citric acid, or less than 0.7 mg carbon powder/liter oil.

Tube assembly requires the use of numerous machined and/or formed plastic and metal components, plus a pump, motor, and heat exchanger along with the x-ray tube insert. As the dielectric oil circulates through and around these components to cool the insert it can become contaminated with particles, mold release, machining fluids, moisture, etc. dissolved or extracted from these materials. These impurities will often lower the dielectric breakdown strength of the oil. Additionally, oxidation of the oil from exposure to radiation in the presence of traces of dissolved air and/or $H_2O$ will lead to the formation of carboxylic acids and high molecular weight oil "sludges". These generated impurities will also decrease the oil dielectric strength with operating time. Occasionally the dielectric strength will decrease sufficiently to produce an arc from one of the high voltage leads to the casing resulting in further damage to the oil, the generation of gaseous products such as acetylene, and a reduction in tube life. For this reason, the dielectric strength of the cooling oil must be maintained as high as possible.

A representative x-ray system embodying the present invention in one preferred form thereof generally includes an oil pump, an anode end, a cathode end, a center section positioned between the anode end and the cathode end, which contains the x-ray tube. A radiator or heat exchanger for cooling the oil is positioned to one side of the center section and may have fans operatively connected to the radiator for providing cooling air flow over the radiator.

During operation, typically, x-ray tube assembly generates a planar beam of radiation which is then rotated around the body. Various detectors, located around the patient, detect the intensity of the beam. Detectors are connected to a computer which, based on intensity readings, generates an image of a slice of the body. The patient is then moved longitudinally through a gantry with the x-ray tube assembly generating image slices so that the computer can form a three-dimensional image of the body.

In the course of operation, much heat is generated by x-ray tube assembly 4 and this heat must be removed if the service life of the x-ray tube is not to be unduly reduced. As described above, it is known to cool x-ray tubes by circulating a fluid, typically oil, within the tube and externally through a cooling system to remove as much heat as possible. In addition to being used as vehicle for cooling, the fluid is also used for its dielectric properties in order to insulate the anode connection from ground and the cathode connection. A representative x-ray system embodying the present invention in one preferred form thereof generally includes an oil pump, an anode end, a cathode end, a center section positioned between the anode end and the cathode end, which contains the x-ray tube. A radiator or heat exchanger for cooling the oil is positioned to one side of the center section and may have fans operatively connected to the radiator for providing cooling air flow over the radiator.

Even employing this type of fluid for purposes of cooling and electrical insulation, x-ray tubes have a finite service life. There are several causes of x-ray tube failure, most of which are related to thermal characteristics of the x-ray tube. Hence, heat removal is an important concern in attempting to extend the service life of an x-ray tube.

A first type of tube failure is related to excessive anode temperature during a single exposure which may result in localized surface melting and pitting of the anode.

A second type of tube failure results from maintaining the anode at elevated temperatures for prolonged periods. If the thermal stress on an x-ray tube anode is maintained for prolonged periods, such as during fluoroscopy, the thermal capacity of the total anode system and of the x-ray tube housing is the limitation to operation.

Coolant fluid, due to continuous heat and repeated arcing, will eventually break down. When the oil breaks down its dielectric properties as well as its ability to carry away heat (i.e. viscosity) are adversely affected. This results in less electrical insulation between the anode connection and ground connections (and/or the cathode connection) which leads to more arcing and, eventually, tube failure. Hence, proper electrical insulation (i.e., maintaining the proper dielectric property of the coolant fluid) is also an important concern in attempting to extend the service life of an x-ray tube.

SUMMARY OF THE INVENTION

Oil is circulated within an x-ray tube casing to cool the tube target thereby extending the time that x-rays can be generated. Since x-ray tubes operate at a high voltage, between 75 to 150 kv, the oil must also be of high dielectric quality to prevent arcing from a high voltage lead to the casing. Incorporation in the cooling circuit of a filter into the oil circulation loop removes contaminants which reduce the dielectric breakdown strength of the oil and thereby extend the service life of the x-ray tube.

The purpose of the invention is to to provide a method for removing harmful impurities which does not require that the x-ray tube be removed from the equipment or the hospital. This is accomplished by incorporating and operating an adsorbing filter within the oil cooling and circulation loop.

DESCRIPTION OF THE DRAWING

FIG. 1 is a schematic representation of a closed cooling loop coolant system for an x-ray tube.

DETAILED DESCRIPTION OF THE INVENTION

The coolant fluid circulated throughout the closed circulation system provides electrical insulation between the anode connection and ground and) removes heat generated by during operation of the x-ray tube. Inevitably, the oil breaks down; in other words, its dielectric properties, as well as its ability to carry away heat (i.e., viscosity), degrades. Also, adding to the overall degradation, an increased number of particulate matter accumulates in the coolant oil due to the oil break down from tube-related heat. Thus, to reduce and/or delay x-ray tube failures thereby extending the service life of an x-ray tube, the present invention employs regular coolant fluid filtering and/or changes without removing the x-ray tube from the scanner.

A filter—drier was plumbed into the circulation loop of an x-ray tube possessing a low oil dielectric breakdown strength of 24 kv. The moisture level in this oil was measured to be 19 ppm. After the filter was added to the system, the oil was circulated for 1 hour and an oil sample removed for evaluation. The oil dielectric strength had increased to 62 kv and the moisture level had decreased to 7 ppm. This evaluation was repeated on three subsequent units which had been identified as possessing low dielectric strength oil with similar results obtained in each case.

Several methods have been identified by which a filter can be used to improve oil quality and thereby extend x-ray tube life and improve performance. The first and most beneficial is to plumb the filter permanently into the oil circulation loop. In this manner, the filter will be present to collect not only moisture and impurities present as a result of tube manufacturing, but also chemical impurities generated or extracted into the oil during tube operation. The addition of the filter within the circulation loop causes a small pressure drop which can be compensated for in the tube design. For existing x-ray tubes the filter can be added in parallel to the heat exchanger resulting in a reduced pressure drop to the system. This embodiment filters a portion of the oil during each full oil circulation exchange.

The composition of the filter itself can be either a commercial product, such as used in the evaluation here, or it can be designed to remove specific types of contaminants. For example, incorporation of activated charcoal into the filter may aid in the removal of organic impurities. Other filters are known which will remove gaseous products resulting from oil degradation.

Filters useful in the practice of this invention for removing particles and other harmful contaminants from the oil include:

1) sintered alumina, sintered glass, sintered molecular sieves, and sintered blends of these. These filters are commonly pressed into a filter core, sintered, then mounted into a container in such a manner that the liquid flows through the sintered core filtering out particles. The pore size of the sintered core, and threfore the minimum particle size which can pass through the filter, is determined from the initial particle size of the filter medium, the pressing pressure, and the final sintering conditions. Activated alumina, such as gamma alumina, will adsorb acidic products formed as a result of oil oxidation or oil degradation. The advantage of using a sintered inorganic core comprised, at least in part, of molecular sieves is that the molecular sieves will remove moisture from the oil in addition to removing particles.
2) woven or non-woven mat of organic fibers such as cellulose, fluorocarbons, or other inert polymeric materials. These mats are restrained by packing against a porous metal screen or porous plate which is in turn, sealed within the enclosure in such a manner that the liquid flows through the fiber mat. The fiber size and pressure used to form the fiber mat determine the capture efficiency for different particle sizes from the oil.
3) sintered porous metal filters in which powdered metals are partially sintered to form a structure with a small residual pore size. These filters may be formed into a conical shape to provide a higher surface area for filtering purposes in order to reduce the pressure drop associated with flowing liquid through a porous metal. Metal screens, typically used to remove larger particle sizes from liquid streams, are not likely to be acceptable here as we need to remove particles less than 10 microns in diameter.
4) non-sintered inorganic powder beds such as rare earth, diatomaceous earth, sand, etc. These powders are supported over a porous metal or porous organic backing.

It is desirable to remove particles from the circulating oil to a minimum of about 3 microns in diameter and preferably to a minimum of about 1 micron in diameter.

1) Data on the dielectric breakdown strength of x-ray tubes before and after filtering for 2 hours with a filter designed to remove particles greater than 3 microns.

| Before | After |
|---|---|
| 21 | 61 |
| 23 | 64 |
| 35 | 69 |
| 19 | 70 |
| 24 | 61 |
| 28 | 55 |
| 24 | 59 |

Measurements of dielectric breakdown strength of the x-ray tube oil, the number of particles filtered out of the oil, and the final oil dielectric strength after filtering. These measurements were made by circulating about 8 liters of oil in a tube through a nominally 3 micron filter, taking an oil sample out, and measuring the dielectric strength and number of particles present in the oil. The oil was replaced and filtered more. The initial oil value was at a dielectric strength of 23 kv and possessed 650,000 particles per 100 cc of oil. The predominant particle contaminants were about 80% organic particles from the various plastic parts and about 20% aluminum particles derived from the heat exchanger.

| Total Time Filtered | Dielectric Strength | Particles in the Oil |
|---|---|---|
| none | 23 kV | 650,000/100 ml oil |
| 15 minutes | 34 kV | 175,000/100 ml oil |
| 30 minutes | 39 kv | 90,000/100 ml oil |
| 60 minutes | 52 kv | 43,000/100 ml oil |
| 120 minutes | 61 kv | 11,000/100 ml oil |
| 180 minutes | 64 kv | 6,000/100 ml oil |

In another aspect of the present invention, wherein the cooling system circulates existing coolant fluid through a closed circulation system which includes the x-ray tube, the present invention relates to a system for providing various functions with respect to the existing fluid in order to extend the service life of the x-ray tube without removing the tube including a filter means coupled to the closed circulation system for continuously filtering coolant fluid and a circulation means, for completing the closed loop and pumping the coolant through the closed circulation system and the filter means.

In operation the cooling fluid follows the flow path indicated by the arrows as it passes through closed cooling system 2. The coolant fluid enters the x-ray tube 4 at the cathode end 6 and exits at anode end 8. The fluid then enters the heat exchanger 10, where it is cooled to a predetermined temperature. Pump 12 provides sufficient pressure to maintain continuous coolant flow as the coolant fluid passes through filter 14 and thence back to the x-ray tube 4.

What is claimed is:

1. A radiographic apparatus including: an x-ray tube coupled with a closed cooling system in which a coolant fluid circulates through the closed cooling system; filter means permanently coupled to the closed cooling system for removing contaminants from the circulating coolant fluid; and circulation means within the closed cooling system for pumping the coolant fluid through the closed cooling system while the radiographic apparatus is in operation;

wherein the filter means is assembled in parallel to a heat exchanger so that a portion of the circulating coolant fluid passes through the filter means during each full fluid circulation exchange.

2. An apparatus according to claim 1 in which the filter means includes woven or non-woven organic fiber mat.

3. An apparatus according to claim 1 in which the filter means includes a filter media comprising sintered alumina, sintered glass, sintered molecular sieves, or sintered blends of these.

* * * * *